US005571037A

United States Patent [19]

Sellers

[11] Patent Number: 5,571,037

[45] Date of Patent: Nov. 5, 1996

[54] NOISE MAKING TOY

[75] Inventor: Craig D. Sellers, Lansing, Ill.

[73] Assignee: Meyer/Glass Design, Chicago, Ill.

[21] Appl. No.: 534,035

[22] Filed: Sep. 26, 1995

[51] Int. Cl.[6] ..... A63H 3/31

[52] U.S. Cl. ..... 446/188; 446/193; 273/324

[58] Field of Search ..... 446/188, 192, 446/193, 195, 196, 197, 213, 180, 184, 398, 399, 400, 473; 273/318, 319, 320, 321, 324, 329; 124/63–79

[56] References Cited

U.S. PATENT DOCUMENTS

| | | | |
|---|---|---|---|
| 787,844 | 4/1905 | Kaiser . | |
| 1,260,013 | 3/1918 | Neats | 446/180 x |
| 1,567,973 | 12/1925 | Mendelson | 446/198 |
| 1,654,500 | 12/1927 | Grubman | 446/188 |
| 1,667,123 | 4/1928 | Koller | 273/324 |
| 2,988,848 | 6/1961 | Lemelson | 446/193 |
| 3,002,318 | 10/1961 | Carver . | |
| 3,087,481 | 4/1963 | Foster | 446/197 X |
| 3,435,554 | 4/1969 | Philips . | |
| 3,687,453 | 8/1972 | Fraga | 273/321 |
| 3,903,865 | 9/1975 | Kaneko . | |
| 4,084,820 | 4/1978 | Olson, Jr. | 446/180 X |
| 4,114,501 | 9/1978 | Tanaka | 446/193 X |
| 4,258,498 | 3/1981 | Aughey . | |
| 4,271,744 | 6/1981 | Kulesza | 446/193 X |
| 4,391,061 | 7/1983 | Fogarty et al. | 446/193 |

FOREIGN PATENT DOCUMENTS

| | | | |
|---|---|---|---|
| 994701 | 11/1951 | France | 446/198 |
| 1005420 | 9/1965 | United Kingdom | 273/324 |

*Primary Examiner*—Robert A. Hafer
*Assistant Examiner*—D. Neal Muir
*Attorney, Agent, or Firm*—Dorn, McEachran, Jambor & Keating

[57] ABSTRACT

A noise making toy in the shape of a hammer. A handle is attached to a collapsible plastic bellows. The bellows has a striking base closing one end and an opening at its opposite end. A sphere closing the opening is attached to the striking base by a tether which may either be rigid or elastic. When the striking base of the bellows is hit against a surface, the bellows is compressed, unseating the sphere and forcing air out through the opening thus creating a noise. When the bellows returns to its uncompressed condition, the tether returns the sphere to its seated position.

7 Claims, 1 Drawing Sheet

3
11
13
15
17
19
21
23
25
27
29
31
33
35
37
41
43
45
47
51
53
61
63
65
67
69
71
81
83
161
163
165
167
169
171
173
175

NOISE MAKING TOY

BACKGROUND AND SUMMARY OF THE INVENTION

This invention is directed to a noise making device which may be incorporated in toys. The device includes a plug which is biased to close an outlet. When air under pressure is forced through the outlet, the plug is unseated creating a noise. After passage of the air through the outlet, the plug is reseated to close the outlet and reestablish the device for a repetition of the noise making cycle. The biasing of the plug is accomplished through the use of an elastic tether or by attaching a tether to a base which moves towards the outlet as the plug is unseated and moves away from the outlet as plug is reseated.

An embodiment of the invention is shown in a noise making toy having a bellows with an opening in one end which is closed by a plug. When the opposite end of the bellows is struck, the bellows is rapidly collapsed unseating the plug and thereby creating a loud noise as the compressed air in the bellows escapes past the plug. A tether connected to the bellows and the plug reseats the plug when the bellows expands. In another embodiment of the invention, the plug is attached to a frame by an elastic tether.

An object of this invention is a noise making toy having an air outlet of a bellows closed by a plug which is tethered to the impactable base of the bellows so that the plug is forced from the air outlet upon compression of the air in the bellows and returned to its closing position relative to the air outlet upon return of the bellows to its extended position.

Another object of this invention is a noise making toy having a collapsible bellows normally closed by a spherical plug.

Another object of this object is a noise making toy in which the displaceable sphere closing the outlet of the bellows is connected to the bellows by a non-rigid tether.

Still another object of this invention is a noise making toy in which the sphere is connected to the base of the bellows by a rigid tether.

Still another object of this invention is a noise making toy in which the sphere is connected to a fixed support by an elastic tether.

Still another object of this invention is a noise making toy in which the seat for the bellows closing plug is formed as an integral part of the bellows.

Still another object of this invention is a noise making toy in which the seat surrounding the outlet for the bellows is formed as a discrete member.

Still another object of this invention is a noise making toy formed in the shape of a hammer and in which the closed end of the bellows is the striking head of the hammer.

Other objects will be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figures 1, 2, 3, 4, 5, 6, 7, 8:
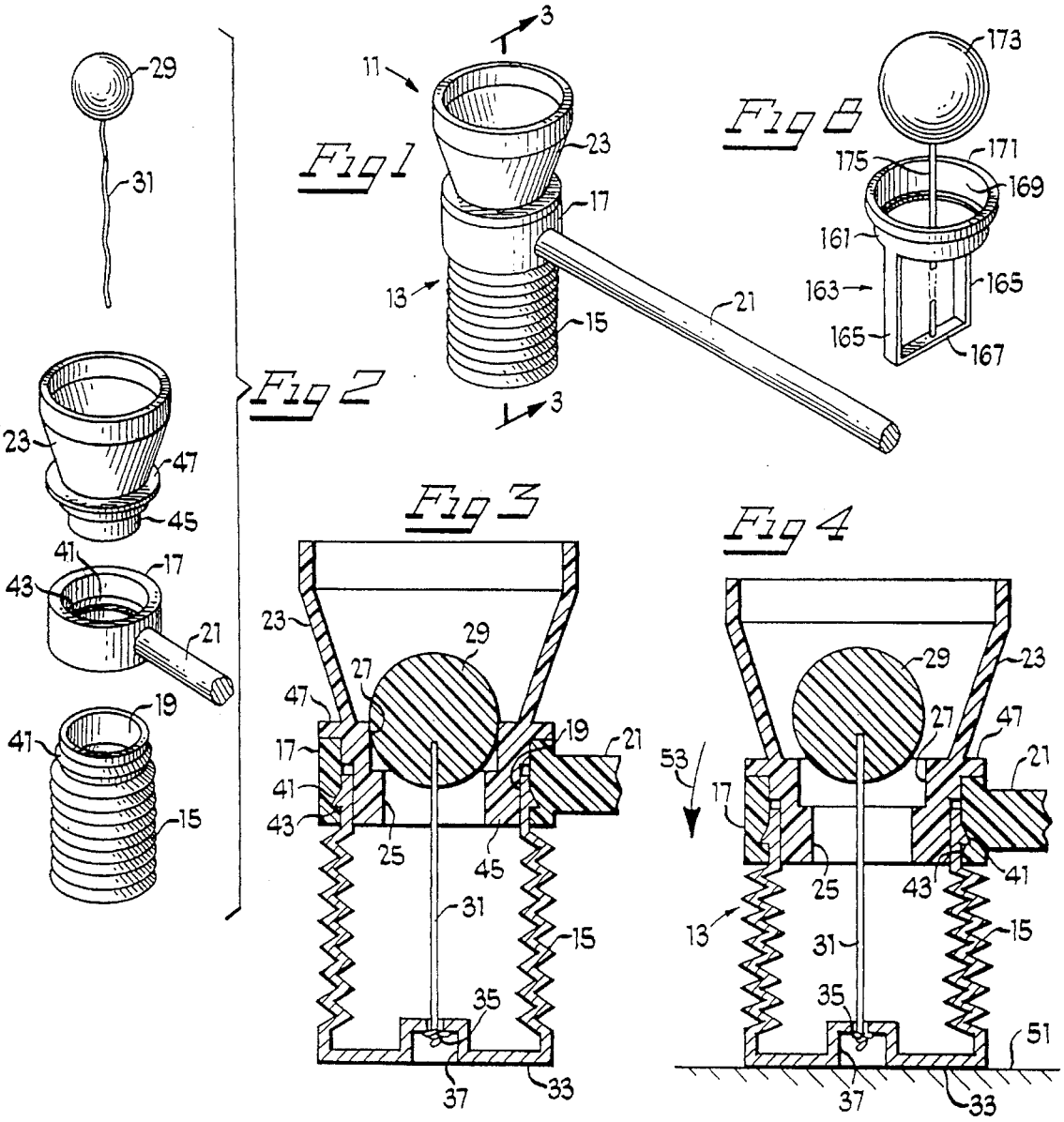
FIG. 1 is a perspective view of the noise making toy of this invention embodied in a hammer-appearing mechanism.
FIG. 2 is an exploded perspective view of the toy of FIG. 1.
FIG. 3 is an enlarged cross sectional view taken along line 3—3 of FIG. 1.
FIG. 4 is a view similar to FIG. 3 but showing the bellows of the toy being compressed as it engages a striking surface while moving in the direction indicated by the arrow.
FIG. 5 is a cross sectional view similar to that of FIG. 3 but showing a modified form of the invention.
FIG. 6 is a cross sectional view similar to that of FIG. 3 showing a modified form of bellows and outlet seat.
FIG. 7 is a cross sectional view of yet another modified form of the invention showing a rigid tether between the outlet closing sphere and the bellows.
FIG. 8 is a perspective view of still another modified form of the invention.

FIGS. 1 and 2 of the drawings show a perspective and exploded perspective views, respectively, of a first embodiment of a noise making toy 11 embodied in a hammer 13. The hammer includes a bellows 15, a ring 17 which connects to the bellows at the open end 19 thereof, and a cup 23 which attaches to the ring and the bellows. An opening 25 leading into the bellows is provided in the cup 23 with the opening 25 surrounded by a seat 27. A plug 29, which in this embodiment is in the shape of a sphere, engages the seat to close the opening 25 into the bellows. The sphere 29 is held in the seat 27 by a tether 31, which in this embodiment, is non-rigid and may be an elastic band, a string, a spring or a length of a non-rigid plastic. The tether 31 is attached to the base 33 of the bellows which base also functions as the hammer's striking surface. So as not to diminish the noise made by the hammer when its striking surface 33 engages a solid object, the attachment of the tether to the bellows, which in this case is accomplished by a knot 35, is located in a recess 37 formed in the base 33 of the bellows.

All of the component parts of the toy hammer 13 heretofore described, including the tether 31, may be formed of plastic, although as previously described, the tether may also be a string, a spring or any elastic material. The bellows 15 is formed with an outwardly projecting annular ridge 41 near its open end 19 which ridge may be received in an inwardly facing annular groove 43 formed in the ring 17 so that the bellows may be snapped into place in the ring as can be most clearly seen in FIG. 3. The cup 23 has a collar 45 of reduced diameter at its lower end which seats inside the open end 19 of the bellows and also has an integral flange 47 adjacent the collar which seats on top of the ring 17. These parts may be connected by adhesive or ultrasonic bonding or any other conventionally known method for attaching plastic parts. When the parts of the hammer are so assembled, the sphere 29 will be seated in the opening 25 in the cup 23 and the tether 31 may be connected so as to hold the sphere firmly against the seat 27 while the bellows 15 is in its uncompressed condition as shown in FIG. 3 of the drawings. Thus, the sphere 29 is held in an air-sealing engagement with the seat 27 of the opening 29.

When the base 33 of the bellows is brought swiftly into contact with a hard surface 51 while being rapidly moved in the direction indicated by the arrow 53 in FIG. 4 of the drawings, the bellows 15 will be partially collapsed compressing the air in the bellows and forcing the air out through the opening 25 in the cup 23. The compression of the bellows 15 moves the seat 27 out of engagement with the sphere 29 allowing the rapid escape of air from the bellows and creating a loud noise. When the bellows returns to its extended or uncompressed condition, the tether 31 reseats the sphere 29 against the seat 27 closing the air outlet from the bellows 15. The hammer is automatically reset for another noise creating blow against a solid surface.

A modified form of the noise making toy 11 of this invention is shown in FIG. 5 of the drawings. The modification is in both the tether and its attachment to the bellows. In this modification, the tether 61 is formed of a rigid length of plastic molded integrally with the sphere 63. A head 65 is formed at the distal end of the tether and this head retains the tether in a cylindrical cup 67 which is attached to a modified recess 69 formed in the base 33 of the bellows. A plastic plug 71 may be used to close the opening into the cup 67 to provide an airtight seal.

FIG. 6 of the drawings shows yet another modification of the invention in which the bellows 81 and seat 83 are molded in a single piece. In this embodiment, a plug, such as sphere 29 having a tether 31, is secured to the recess 37 by a knot 35 at the end of the tether.

FIG. 7 of the drawings shows still another modification of the invention in which the bellows 81 and integral seat 83 are used with a sphere 63 having an integral tether 61 with the tether having a head 65 which fastens the tether to a cup 67 formed integrally with the bellows base 33. The cup may be closed by a plug 71 to provide an airtight seal for the bellows.

FIG. 8 of the drawings shows a modification of the invention which is adaptable for inclusion in a wide variety of toys, including toys with and without bellows. It is particularly adaptable for use in toys in which the source of compressed air is other than a bellows. This modified form of the invention is also desirable for installation in bellows of various sizes since it is not necessary to design the tether so that it can be attached to the base of the bellows. The modification of FIG. 8 is formed of plastic and includes a ring 161 which is formed integrally with a frame 163. Frame 163 includes legs 165 connected by a cross-bar 167. An opening or air passage 169 is formed in the ring 161 in the passages surrounded by a seat 171. A plug 173, in the shape of a sphere, engages the seat to close the air passage 169. An elastic tether 175 connects the plug 173 to the cross-bar 167 to bias the plug 173 into closing engagement with the seat 171.

Although the noise making toy 11 is shown and described as embodied in a hammer 13, it should be understood and appreciated that it may be embodied in other types of toys as well as noise making devices that are not toys.

I claim:

1. A noise making toy including:

a tubular bellows having an elongated, pleated tubular wall with opposite ends, a base closing one end of said tubular bellows, an opening into said bellows formed at the opposite end thereof, a seat surrounding said opening, a plug seated on said seat and a tether directly connecting said plug to said base said bellows to maintain said plug on said seat when said pleated tubular wall is in an extended position and to allow said plug to unseat from said seat upon the build up of air pressure in said bellows thereby releasing air to create a noise.

2. The noise making toy of claim 1 in which said seat surrounding said opening is annular and said plug is a sphere.

3. The noise making toy of claim 2 in which a collar is attached to said opposite end of said tubular wall, an insert is positioned in said collar and said annular seat is formed on said insert.

4. The noise making toy of claim 1 in which said tether is rigid.

5. The noise making toy of claim 1 in which said tether is elastic.

6. The noise making toy of claim 1 in which a handle is attached to said bellows.

7. A noise making toy including:

a bellows having an elongated, pleated tubular wall with opposite ends, a base closing one end of said tubular wall an opening into said bellows formed at the opposite end of said tubular wall, a seat surrounding said opening, a plug engaging said opening and an anchored elastic tether anchored to said base and directly connected to said plug to hold said plug in engagement with said seat until air forced through said opening by the compression of said bellows forces said plug off said seat to release said air and create a noise.

* * * * *